US008803039B2

(12) United States Patent
Sato et al.

(10) Patent No.: US 8,803,039 B2
(45) Date of Patent: Aug. 12, 2014

(54) HEATING UNIT, SUBSTRATE PROCESSING APPARATUS, AND METHOD FOR HEATING FLUID

(75) Inventors: Hideaki Sato, Tosu (JP); Hiromi Hara, Tosu (JP)

(73) Assignee: Tokyo Electron Limited, Minato-Ku (JP)

( * ) Notice: Subject to any disclaimer, the term of this patent is extended or adjusted under 35 U.S.C. 154(b) by 1156 days.

(21) Appl. No.: 12/509,725

(22) Filed: Jul. 27, 2009

(65) Prior Publication Data

US 2010/0078423 A1 Apr. 1, 2010

(30) Foreign Application Priority Data

Sep. 29, 2008 (JP) ..... 2008-250288

(51) Int. Cl.
*F27D 11/00* (2006.01)

(52) U.S. Cl.
USPC ..... 219/439

(58) Field of Classification Search
USPC ..... 219/482–519; 392/416, 420; 118/723, 118/724
See application file for complete search history.

(56) References Cited

U.S. PATENT DOCUMENTS

| | | | | |
|---|---|---|---|---|
| 3,735,805 | A | 5/1973 | Stillhard | |
| 5,866,880 | A | 2/1999 | Seitz et al. | |
| 6,080,971 | A * | 6/2000 | Seitz et al. | 219/483 |
| 6,389,226 | B1 * | 5/2002 | Neale et al. | 392/485 |

FOREIGN PATENT DOCUMENTS

| | | | |
|---|---|---|---|
| DE | 17 79 440 | A | 9/1971 |
| DE | 696 33 933 | T2 | 4/2005 |
| JP | 11262174 | A * | 9/1999 |
| JP | 3467401 | B2 | 8/2003 |

* cited by examiner

*Primary Examiner* — Henry Yuen
*Assistant Examiner* — Thomas Ward
(74) *Attorney, Agent, or Firm* — Burr & Brown, PLLC

(57) ABSTRACT

In a heating unit, based on a required output amount Q, a control part 50 performs: (A) when the required output amount Q is not more than a predetermined set value, a control in which none of the heating devices 24*a* is continuously kept on throughout a heating cycle, and all or one or more heating devices 24*a* are controlled in a periodically divided manner; and (B) when the required output amount is larger than the predetermined set value, a control in which all or one or more heating devices 24*a* are continuously kept on throughout the heating cycle, and all or one or more heating devices 24*a* among the remaining heating devices 24*a* are controlled in the periodically divided manner during this heating cycle. At this time, a difference between the maximum number and the minimum number of the heating devices 24*a* that are simultaneously kept on during the heating cycle is made not more than 1.

14 Claims, 6 Drawing Sheets

HEATING UNIT, SUBSTRATE PROCESSING APPARATUS, AND METHOD FOR HEATING FLUID

CROSS REFERENCE TO RELATED APPLICATIONS

This application is based upon and claims the benefit of priority from the prior Japanese Patent Application No. 2008-250288 filed on Sep. 29, 2008, the entire contents of which are incorporated herein by reference.

FIELD OF THE INVENTION

The present invention relates to a heating unit configured to heat a fluid, a substrate processing apparatus comprising the heating unit, and a method for heating a fluid by the heating unit. Particularly, the present invention relates to the heating unit, the substrate processing apparatus, and the method for heating a fluid, wherein a heating degree of the fluid during a heating cycle does not drastically vary over time.

BACKGROUND OF THE INVENTION

There has been conventionally known a substrate processing apparatus configured to process a substrate such as a semiconductor wafer and a glass substrate (hereinafter simply referred to as "wafer"), by immersing the wafer in a process liquid such as a deionized water and a chemical liquid. Such a substrate processing apparatus includes: a processing tank storing a process liquid, the processing tank being configured to process a plurality of, e.g., fifty wafers by immersing the wafers all together in the process liquid stored therein; and a circulation path to which the process liquid is sent from the processing tank, and through which the process liquid is returned to the processing tank.

It is preferable that the process liquid stored in the processing tank is maintained at a preset temperature, in order that a wafer can be suitably processed. Thus, the circulation path is provided with a heating unit configured to heat a process liquid flowing through the circulation path. By heating the process liquid flowing through the circulation path by the heating unit, the process liquid in the processing tank can be maintained at a preset temperature. In addition, the processing tank is provided with a temperature measuring sensor configured to measure a temperature of the process liquid stored in the processing tank. Further, the substrate processing apparatus includes a control part configured to control the heating unit based on the temperature of the process liquid which is measured by the temperature measuring sensor. The control part is configured to control the heating unit so as to adjust a heating degree of the process liquid heated by the heating unit, such that the temperature of the process liquid measured by the temperature measuring sensor can be maintained at a preset temperature.

More specifically, the heating unit includes a plurality of (e.g., four) heaters that are arranged in parallel. The control part performs an ON/OFF control of the respective heaters, so as to adjust a heating degree of the process liquid heated by the heating unit. As an ON/OFF control method of each heater by a control part, the method disclosed in the specification of JP Patent No. 3467401 is known, for example.

With reference to FIGS. 6 and 7, there is described the ON/OFF control of each heater which is disclosed in the JP Patent No. 3467401. As shown in FIG. 6, the control part is configured to control all the heaters in a periodically divided manner during each heating cycle. Herein, the control of the heaters in the periodically divided manner means a control in which the respective heaters are alternately kept on for a predetermined heater turn-on time during each heating cycle, with intervals between timings at which the respective heaters are switched on being made constant. To be more specific, as shown in FIG. 6, during each heating cycle, a heater 1 out of the four heaters is firstly switched on. Then, after a predetermined period has passed from when the heater 1 was switched on, a heater 2 is switched on. Then, after a predetermined period has passed from when the heater 2 was switched on, a heater 3 is switched on. Then, after a predetermined period has passed from when the heater 3 was switched on, a heater 4 is switched on. After being switched on, the heaters 1 to 4 are respectively kept on for a predetermined heater turn-on time. After a predetermined heater turn-on time has passed from when the heater 4 was switched on, the heater 4 is switched off. At this time, a certain heating cycle is completed, and a succeeding heating cycle is started.

When all the heaters are simultaneously kept on for a predetermined time during each heating cycle, there is a possibility that some of the heaters or all the heaters could not be simultaneously used, when the heaters come to the end of their lives because of the long use of the heating unit. On the other hand, as shown in FIG. 6, when all the heaters are controlled in the periodically divided manner during each heating cycle, the heaters are alternately kept on during each heating cycle. Thus, it can be restrained that some heaters or all the heaters cannot be simultaneously used when the heating unit is used for a long time.

When tungsten inside the heater of the heating unit is evaporated and run out, the heater experiences a breaking of wire. Upon the braking of wire, the heater cannot be used. In order to withhold the evaporation of tungsten, it is effective that a current value of the heater is increased during the use thereof, and that a temperature in a lamp of the heater is increased. Due to the increase in the temperature in the lamp of the heater, a pressure in the lamp is increased so that the evaporation of the tungsten can be restrained.

More specifically, in order to withhold the evaporation of the tungsten inside the heater, the temperature in the heater is required to be within a predetermined range, specifically, a range between 250° C. and 400° C., for example. In order that the temperature in the heater can be within the predetermined range, it is necessary that each heater turn-on time is set at a predetermined time, specifically, two seconds or more.

SUMMARY OF THE INVENTION

As shown in FIG. 6, in the method disclosed in JP Patent No. 3467401 in which all the heaters are controlled in the periodically divided manner during each heating cycle, when a ratio of the heater turn-on time relative to the period of the heating cycle is small, the heaters are alternately kept on. However, when a ratio of the heater turn-on time relative to the period of the heating cycle is large, as shown in FIG. 7, some of the heaters may simultaneously kept on. As shown in FIG. 7, when all the heaters are controlled in the periodically divided manner during each heating cycle, the number of the heaters that are simultaneously kept on during each heating cycle varies from one to four. When the number of heaters that simultaneously kept on during each heating cycle varies from one to four, a heating degree of the process liquid heated by the heating unit may become non-uniform.

Namely, in an initial stage of a heating cycle, the process liquid is heated by the one heater. However, as time goes by, the number of the heaters that heat the process liquid increases, and the process liquid is heated by the four heaters in a middle stage of the heating cycle. Thereafter, the number of the heaters that heat the process liquid decreases, and the process liquid is heated by the one heater in a final stage of the heating cycle. Since the number of the heaters that heat the process liquid drastically varies during the heating cycle, there is a problem in that a heating degree of the process liquid also drastically varies during the heating cycle.

The present invention has been made in view of the above circumstances. The object of the present invention is to provide a heating unit, a substrate processing apparatus, and a method for heating a fluid, wherein a heating degree of the fluid during a heating cycle does not drastically vary over time.

The heating unit of the present invention is a heating unit configured to heat a fluid, the heating unit comprising: a plurality of heating devices respectively configured to heat the fluid; and a control part configured to control the respective heating devices, the control part controlling ON/OFF of all the heating devices or one or more heating devices respectively; wherein: the control part calculates a required output amount of the heating unit such that a temperature of the fluid heated by the heating unit can be maintained at a predetermined temperature, and calculates a period of a heating cycle as a synchronization for controlling the heating unit based on the required output amount; and the control part performs: A) when the required output amount is not more than a predetermined set value, a control in which none of the heating devices is continuously kept on throughout the heating cycle, and all or one or more heating devices are controlled in a periodically divided manner during this heating cycle; and (B) when the required output amount is larger than the predetermined set value, a control in which all or one or more heating devices are continuously kept on throughout the heating cycle, and all or one or more heating devices among the remaining heating devices are controlled in the periodically divided manner during this heating cycle; and at this time, the control part controls each heating device such that a difference between the maximum number and the minimum number of the heating devices that are simultaneously kept on during the heating cycle is not more than 1.

Herein, the control in the periodically divided manner means a control in which the respective heating devices are alternately kept on for a predetermined time during the heating cycle, with intervals between timings at which the respective heating devices are switched on being made constant.

According to the heating unit of the present invention, the control part calculates a required output value such that a temperature of a process liquid heated by the heating unit can be maintained at a predetermined temperature. Based on the required output value, the control part calculates a period of a heating cycle as a synchronization for controlling the heating unit. Then, when the required output value is not more than a predetermined set value, the control part performs a control in which none of the heating devices is continuously kept on throughout the heating cycle. When the required output amount is larger than the predetermined set value, the control part performs a control in which all or one or more heating devices are continuously kept on throughout the heating cycle. Further, during this heating cycle, the control part performs a control in which all or one or more of the remaining heating devices are controlled in the periodically divided manner. At this time, the control part controls ON/OFF of each heating device such that a difference between the maximum number and the minimum number of the heating devices that are simultaneously kept on during the heating cycle is not more than 1. Namely, since there is selectively performed the control in which all the heating devices or one or more heating devices are continuously kept on throughout the heating cycle such that a difference between the maximum number and the minimum number of the heating devices that are simultaneously kept on during the heating cycle is not more than 1, the number of the heating devices that are simultaneously kept on can be prevented from drastically varying during the heating cycle. Therefore, it can be restrained that a heating degree of the process liquid during the heating cycle drastically varies over time.

In the heating unit of the present invention, it is preferable that, in the control part, the predetermined time in the control of the periodically divided manner is previously set at a predetermined value or more. In this case, it can be prevented that the heater turn-on time becomes shorter than the predetermined time, resulting in a breaking of wire of the heating device.

In the heating unit of the present invention, it is preferable that, based on the required output amount, the control part selectively performs: (a) a control in which all the heating devices are controlled in the periodically divided manner during the heating cycle; (b) a control in which one or more heating devices is controlled in the periodically divided manner during the heating cycle; (c) a control in which one or more heating devices is continuously kept on throughout the heating cycle, and all the heating devices among the remaining heating devices are controlled in the periodically divided manner during this heating cycle; (d) a control in which one or more heating devices is continuously kept on throughout the heating cycle, and one or more heating devices among the remaining heating devices is controlled in the periodically divided manner during this heating cycle; and (e) a control in which all the heating devices are continuously kept on throughout the heating cycle.

In the heating unit of the present invention, the number of the heating devices can be three; and the control part performs: when the required output amount is not more than a first set value, a control in which the three heating devices are controlled in the periodically divided manner during the heating cycle; when the required output amount is larger than the first set value and not more than a second set value, a control in which the two heating devices are controlled in the periodically divided manner during the heating cycle; when the required output amount is larger than the second set value and smaller than a third set value, a control in which the one heating device is continuously kept on throughout the heating cycle, and the remaining two heating devices are controlled in the periodically divided manner during this heating cycle; and when the required output amount is the third set value, the three heating devices are continuously kept on throughout the heating cycle.

Alternatively, the number of the heating devices can be four; and the control part performs: when the required output amount is not more than a first set value, a control in which the four heating devices are controlled in the periodically divided manner during the heating cycle; when the required output amount is larger than the first set value and not more than a second set value, a control in which the two or three heating devices are controlled in the periodically divided manner during the heating cycle; when the required output amount is larger than the second set value and not more than a third set value, a control in which the one heating device is continuously kept on throughout the heating cycle, and the remaining three heating devices are controlled in the periodically divided manner during this heating cycle; when the required output amount is larger than the third set value and not more than a fourth set value, a control in which the one heating device is continuously kept on throughout the heating cycle, and the remaining two heating devices are controlled in the periodically divided manner during this heating cycle; when the required output amount is larger than the fourth set value and smaller than a fifth set value, a control in which the two heating devices are continuously kept on throughout the heating cycle, and the remaining two heating devices are controlled in the periodically divided manner during this heating cycle; and when the required output amount is the fifth set value, the four heating devices are continuously kept on throughout the heating cycle.

In the heating unit of the present invention, it is preferable that the control part makes the predetermined time constant in the control of periodically divided manner; the control part calculates an operation amount within a range between 0 and 1 by means of a feedback control, such that a temperature of the fluid heated by the heating unit can be maintained at a predetermined temperature; the control part calculates the required output amount by multiplying the operation amount by the number of the heating devices; and the control part calculates a period of the heating cycle based on the required output amount and the predetermined time.

In the heating unit of the present invention, it is preferable that the control unit is capable of storing a cumulative time during which each heating device is kept on; and when one or more heating devices are continuously kept on throughout the heating cycle, the control part controls the respective heating devices such that each heating device to be used is sequentially selected in order of the length of their respective cumulative time of use, such that the heating device with the shorter cumulative time of use is selected preferentially. Therefore, when one or more heating device is continuously kept on throughout a heating cycle, the heating device with a shorter cumulative time of use is preferentially used. Therefore, a time point at which each heating device of the heating unit cannot be used because of its life can be delayed, whereby an exchange frequency of the heating device in the heating unit can be decreased.

In the heating unit of the present invention, it is preferable that the control unit is capable of storing a cumulative time during which each heating device is kept on; and when one or more heating devices is controlled in the periodically divided manner, the control part controls the respective heating devices such that each heating device to be used is sequentially selected in order of the length of their respective cumulative time of use, such that the heating device with the shorter cumulative time of use is selected preferentially. Thus, when one or more heating device is controlled in the periodically divided manner during a heating cycle, the heating device with a shorter cumulative time of use is preferentially used. Therefore, a time point at which each heating device of the heating unit cannot be used because of its life can be delayed, whereby an exchange frequency of the heating device in the heating unit can be decreased.

The substrate processing apparatus of the present invention is a substrate processing apparatus comprising: a processing tank configured to process a substrate by means of a process liquid; a circulation path to which the process liquid is sent from the processing tank, and through which the process liquid is returned to the processing tank; a heating unit described above, the heating unit being disposed in the circulation path so as to heat the process liquid flowing through the circulation path; and a temperature measuring part configured to measure a temperature of the process liquid in the processing tank; wherein: the control part of the heating unit calculates a required output amount in the heating unit by a feedback control, such that a temperature of the process liquid measured by the temperature measuring part can be maintained at a predetermined temperature; the control part calculates, based on the required output amount, a period of a heating cycle as a synchronization for controlling the heating unit; and the control part controls the respective heating devices of the heating unit.

The method for heating a fluid of the present invention is a method for heating a fluid by means of a heating unit including a plurality of heating devices respectively configured to heat the fluid, the method comprising: calculating a required output value such that a temperature of the fluid heated by the heating unit can be maintained at a predetermined temperature; calculating a period of a heating cycle as a synchronization for controlling the heating unit based on the required output amount; and controlling each heating device based on the required output amount, such that: (A) when the required output amount is not more than a predetermined set value, there is performed a control in which none of the heating devices is continuously kept on throughout the heating cycle, and all or one or more heating devices are controlled in a periodically divided manner during this heating cycle; (B) when the required output amount is larger than the predetermined set value, there is performed a control in which all or one or more heating devices are continuously kept on throughout the heating cycle, and all or one or more heating devices among the remaining heating devices are controlled in the periodically divided manner during this heating cycle; and, at this time, a difference between the maximum number and the minimum number of the heating devices that are simultaneously kept on during the heating cycle is not more than 1.

Herein, the control of the periodically divided manner means a control in which the respective heating devices are alternately kept on for a predetermined time during the heating cycle, with intervals between timings at which the respective heating devices are switched on being made constant.

According to the method for heating a fluid of the present invention, a required output value is calculated such that a temperature of a process liquid heated by the heating unit can be maintained at a predetermined temperature. Based on the required output value, a period of a heating cycle is calculated as a synchronization for controlling the heating unit. Then, when the required output value is not more than a predetermined set value, there is performed a control in which none of the heating devices is continuously kept on throughout the heating cycle. When the required output amount is larger than the predetermined set value, there is performed a control in which all or one or more heating devices are continuously kept on throughout the heating cycle. Further, during this heating cycle, there is performed a control in which all or one or more of the remaining heating devices are controlled in the periodically divided manner. At this time, ON/OFF of each heating device is controlled such that a difference between the maximum number and the minimum number of the heating devices that are simultaneously kept on during the heating cycle is not more than 1. Namely, since there is selectively performed the control in which all the heating devices or one or more heating devices are continuously kept on throughout a heating cycle such that a difference between the maximum number and the minimum number of the heating devices that are simultaneously kept on during the heating cycle is not more than 1, the number of the heating devices that are simultaneously kept on can be prevented from drastically varying during the heating cycle. Therefore, it can be restrained that a heating degree of the process liquid during the heating cycle drastically varies over time.

In the method for heating a fluid of the present invention, it is preferable that the predetermined time in the control of the periodically divided manner is previously set at a predetermined value or more. In this case, it can be prevented that the heater turn-on time becomes shorter than the predetermined time, resulting in a breaking of wire of the heating device.

In the method for heating a fluid of the present invention, it is preferable that, when each heating device is controlled, there is selectively performed, based on the required output amount: (a) a control in which all the heating devices are controlled in the periodically divided manner during the heating cycle; (b) a control in which one or more heating devices is controlled in the periodically divided manner during the heating cycle; (c) a control in which one or more heating devices is continuously kept on throughout the heating cycle, and all the heating devices among the remaining heating devices are controlled in the periodically divided manner during this heating cycle; (d) a control in which one or more heating devices is continuously kept on throughout the heating cycle, and one or more heating devices among the remaining heating devices is controlled in the periodically divided manner during this heating cycle; and (e) a control in which all the heating devices are continuously kept on throughout the heating cycle.

DETAILED DESCRIPTION OF THE INVENTION

An embodiment of the present invention will be described hereinbelow with reference to the drawings. Firstly, an overall structure of a substrate processing apparatus of a batch type in this embodiment is described with reference to FIG. 1.

Figure 1:
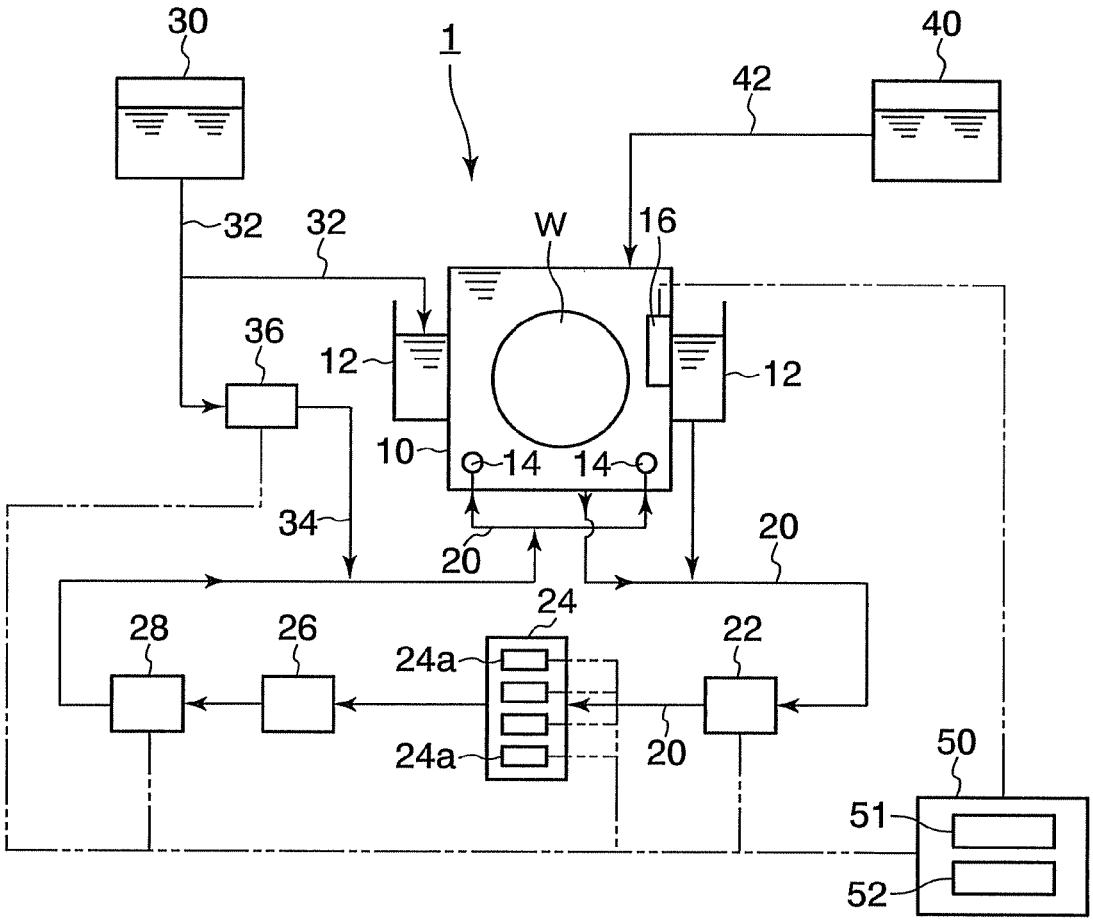
FIG. 1 is a schematic structural view showing an overall structure of a substrate processing apparatus in one embodiment of the present invention.

As shown in FIG. 1, the batch type substrate processing apparatus 1 includes: a processing tank 10 storing a process liquid such as a deionized water and a chemical liquid, the processing tank 10 being configured to process a plurality of, e.g., fifty substrates such as semiconductor wafers and glass substrates (hereinafter also referred simply as "wafers"), by immersing the wafers W all together in the process liquid stored therein; and a circulation path 20 to which the process liquid is sent from the processing tank 10, and through which the process liquid is returned to the processing tank 10. In addition, the substrate processing apparatus 1 is provided with a control part 50 configured to control the respective structural elements of the substrate processing apparatus 1.

An overflow tank 12 is disposed around the processing tank 10. Thus, the process liquid outflowing from the processing tank 10 is sent to the overflow tank 12. As shown in FIG. 1, the process liquid sent to the overflow tank 12 is also sent to the circulation path 20. Further, arranged in the processing tank 10 is a process-liquid supply part 14 formed of, e.g., a process-liquid supply nozzle that supplies a process liquid into the processing tank 10. The process-liquid supply part 14 is connected to a downstream end of the circulation path 20. Furthermore, arranged in the processing tank 10 is a temperature measuring sensor 16 configured to measure a temperature of the process liquid stored in the processing tank 10. A result of the temperature of the process liquid which is measured by the temperature measuring sensor 16 is sent to the control part 50.

The circulation path 20 is equipped with a circulation pump 22, a heating part 24, a filter 26, and a flowmeter 28, in this order from the upstream side. The circulation pump 22 is configured to draw the process liquid stored in the processing tank 10, transfer the process liquid through the circulation path 20, and to return the process liquid again to the processing tank 10 from the process liquid supply part 14. An operation of the circulation pump 22 is controlled by the control part 50.

The heating part 24 includes a plurality of, e.g., four heaters 24*a* that are arranged in parallel. The process liquid flowing through the circulation path 20 is heated by the respective heaters 24*a*. Hereinafter, these four heaters 24*a* are referred to as "heater 1" to "heater 4" (see, FIGS. 2 and 3). ON and OFF of the one heater 24*a* is controlled independently from the other heaters 24*a* by the control part 50. Details of the ON/OFF control of each heater 24*a* by the control part 50 will be described hereafter.

As shown in FIG. 1, the circulation path 20 has the filter 26. The process liquid flowing through the circulation path 20 is percolated by the filter 26.

The flowmeter 28 is configured to measure a flow rate of the process liquid flowing through the circulation path 20. A result of the flow rate of the process liquid which is measured by the flowmeter 28 is sent to the control part 50.

The substrate processing apparatus 1 further includes a hydrogen-peroxide-water storage tank 30 storing a hydrogen peroxide water ($H_2O_2$), and a supply pipe 32 through which a hydrogen peroxide water is supplied from the hydrogen-peroxide-water storage tank 30 to the overflow tank 12. The hydrogen peroxide water sent from the hydrogen-peroxide-water storage tank 30 to the supply pipe 32 is sent to the overflow tank 12. Then, the hydrogen peroxide water supplied to the overflow tank 12 is sent to the processing tank 10 through the circulation path 20. The supply pipe 32 is branched at an intermediate position thereof. A branch pipe 34 branched from the supply pipe 32 is connected to the circulation path 20 at a position downstream the flowmeter 28. The branch pipe 34 is equipped with a supplementary pipe 36. An operation of the supplementary pipe 36 is controlled by the control part 50. Due to the provision of the branch pipe 34 and the supplementary pump 36, the hydrogen peroxide water sent from the hydrogen-peroxide-water storage tank 30 to the supply pipe 32 can be sent through the branch pipe 34 to the circulation path 20 at the position downstream the flowmeter 28. Thus, a supply path of the hydrogen peroxide water into the processing tank 10 can be reduced.

The substrate processing apparatus 1 further includes a sulfuric-acid storage tank 40 storing sulfuric acid ($H_2SO_4$), and a supply pipe 42 through which sulfuric acid is supplied from the sulfuric-acid storage tank 40 to the processing tank 10. The sulfuric acid sent from the sulfuric-acid storage tank 40 to the supply pipe 42 is sent into the processing tank 10.

The control part 50 is connected to the respective elements of the substrate processing apparatus 1 so as to control operations of the respective elements. Specifically, sent to the control part 50 are a measurement result of a temperature of the process liquid in the processing tank 10 which is measured by the temperature measuring sensor 16, and a measurement result of a flow rate of the process liquid flowing through the circulation path 20 which is measured by the flowmeter 28. In addition, the control part 50 is configured to control operations of the circulation pump 22, the respective heaters 24*a* of the heating part 24, and the supplementary pump 36. To be more specific, the control part 50 is configured to control ON/OFF of each heater 24*a* of the heating part 24, such that a temperature of the process liquid measured by the temperature measuring sensor 16 can be maintained at a preset temperature.

In this embodiment, the control part 50 includes a control computer 51 formed of a CPU, and a storage medium 52 connected to the control computer 51. The storage medium 52 stores a program for executing a method for processing the wafer W, which will be described hereafter, and various set data. The storage medium 52 may be constituted by a memory such as a ROM and a RAM, a hard disc, a disk-like storage medium such as a CD-ROM, and other known storage medium. As far as a program executable by the control computer 51 of the substrate processing apparatus 1 can be stored, any type of storage medium may be used as the storage medium 52.

In the present invention, a heating unit is composed of the respective heaters 24*a* of the heating part 24 and the control part 50.

Next, an operation of the substrate processing apparatus 1 as structured above is described.

At first, sulfuric acid is sent from the sulfuric-acid storage tank 40 into the processing tank 10 through the supply pipe 42. In addition, a hydrogen peroxide water is sent from the hydrogen-peroxide-water storage tank 30 into the overflow tank 12 through the supply pipe 32. These sulfuric acid and the hydrogen peroxide water are used as a process liquid. The process liquid outflowing from the processing tank 10 is sent to the overflow tank 12. The process liquid is sent from the processing tank 10 and the overflow tank 12 to the circulation path 20, and the process liquid is transferred through the circulation path 20 by the circulation pump 22 so as to be returned again to the processing tank 10 from the process-liquid supply part 14. At this time, the process liquid flowing through the circulation path 20 is heated by the respective heaters 24*a* of the heating part 24. The process liquid flowing through the circulation path 20 is percolated by the filter 26, so that impurities are removed from the process liquid. A flow rate of the process liquid flowing through the circulation path 20 is measured by the flowmeter 28.

Then, a plurality of, e.g., fifty wafers W are processed by the chemical liquid by immersing the wafers W all together in the process liquid stored in the processing tank 10. At this time, it is preferable that a temperature of the process liquid is maintained at a present temperature.

Next, a method for maintaining a temperature of the process liquid in the processing tank 10 at a preset temperature is described with reference to FIGS. 2 and 3. As described above, adjustment of the temperature of the process liquid in the processing tank 10 is performed by the control part 50 that controls ON/OFF of each heater 24*a* of the heating part 24, based on a measurement result of the temperature of the process liquid measured by the temperature measuring sensor 16.

As shown in FIGS. 2 and 3, the control part 50 is configured to control ON/OFF of each heater 24*a* such that all the heaters 24*a* (i.e., four heaters 24*a*) or one or more of the heaters 24*a* are kept on for a heater turn-on time during each heating cycle. The heater turn-on time is previously set at a predetermined time or more. Specifically, the heater turn-on time is set at two seconds, for example.

In more detail, the control part 50 calculates a MV value (operation amount) within a range between 0 and 1 by means of a feedback control such as a PID control, such that a temperature of the process liquid measured by the temperature measuring sensor 16 can be maintained at a preset temperature. Then, a Q value (output required amount) is calculated by multiplying the MV value by the number of the heaters 24*a* and by centuplicating the multiplied value. When the number of the heaters 24*a* is four, the Q value varies within a range between 0 and 400. The Q value is a total sum of the output amounts (%) required to the respective heaters 24*a*, and a maximum value of the Q value is the number of the heaters multiplied by 100(%).

In addition, a period of a heating cycle is calculated based on the preset heater turn-on time and the Q value (output required amount). A concrete method for calculating a period of a heating cycle will be described herebelow.

The control part 50 is configured to calculate the MV value and the Q value over time (in a continuous manner). On the other hand, the period of a heating cycle is calculated when each heating cycle is completed. However, the calculation of the period of the heating cycle is not limited to the completion of each heating cycle, and may be performed in the course of each heating cycle. In addition, before the heating cycle is completed, there may be a case in which the MV value calculated by the control part 50 excess a preset value (e.g., 0.05) and/or a breakage such as a breaking of wire of the heater 24*a* is detected. In this case, the calculation of the period of the heating cycle may be performed again.

Figure 2A:
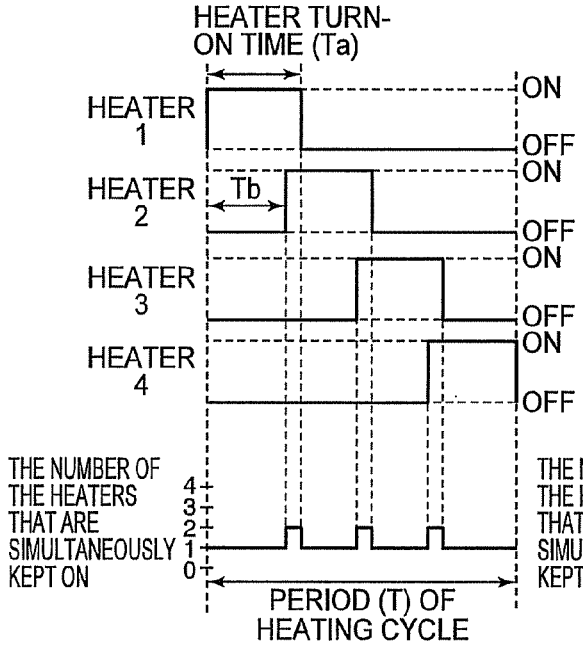
FIGS. 2A to 2D are explanatory views showing an ON/OFF control of each heater by a control part in a heating unit including four heaters.
Figure 2B:
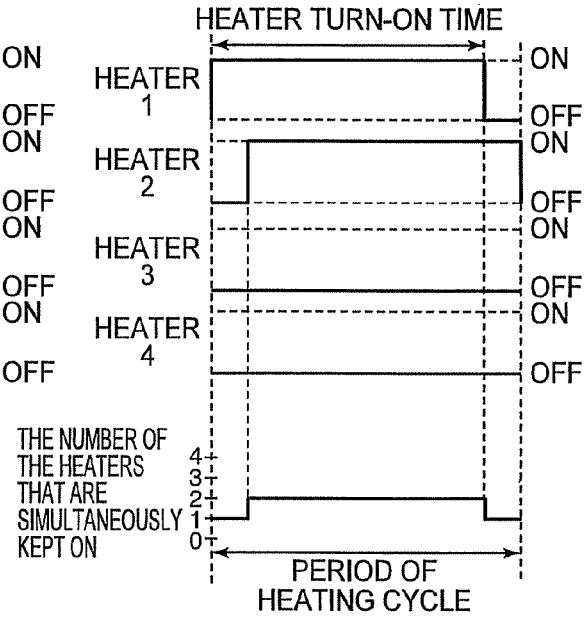

Based on the Q value (output required amount), the control part 50 controls ON/OFF of each heater 24*a* such that all the heaters 24*a* (i.e., four heaters 24*a*) or one or more of the heaters 24*a* are kept on for the preset heater turn-on time during each heating cycle. At this time, as shown in FIGS. 2A and 2B, when the Q value is not more than a predetermined set value, specifically, when the Q value is not more than 200, for example, the control part 50 performs a control in which none of the heaters 24*a* is continuously kept on throughout the heating cycle, and all the heaters 24*a* or one or more heaters 24*a* are controlled in the periodically divided manner during this heating cycle. On the other hand, as shown in FIGS. 2C and 2D and FIGS. 3A and 3B, when the Q value is larger than the predetermined set value, specifically, when the Q value is larger than 200, for example, the control part 50 performs a control in which all or one or more heaters 24*a* are continuously kept on throughout the heating cycle, and all the remaining heaters 24*a* or one or more remaining heaters 24*a* are controlled in the periodically divided manner during this heating cycle. At this time, as shown in FIGS. 2A to 2D and FIGS. 3A and 3B, ON/OFF of each heater 24*a* is controlled such that a difference between the maximum number and the minimum number of the heaters 24*a* that are simultaneously kept on during the heating cycle is not more than 1.

Herein, the control of the heaters 24*a* in the periodically divided manner means a control in which the respective heaters 24*a* are alternately kept on for a predetermined heater turn-on time during each heating cycle, with intervals between timings at which the respective heaters 24*a* are switched on being made constant. The control in the periodically divided manner is described below, taking the ON/OFF control of each heater 24*a* shown in FIG. 2A by way of example. During each heating cycle, the heater 1 of the four heaters 24*a* is firstly switched on. Then, after a predetermined period has passed from when the heater 1 was switched on, the heater 2 is switched on. Then, after a predetermined period has passed form when the heater 2 was switched on, the heater 3 is switched on. Then, after a predetermined period has passed from when the heater 3 was switched on, the heater 4 is switched on. After being switched on, the heaters 1 to 4 are respectively kept on for the predetermined heater turn-on time. Then, as shown in FIG. 2A, after the predetermined heater turn-on time has passed from when the heater 4 was switched on, the heater 4 is switched off. At this time, the certain heating cycle is completed, and a succeeding heating cycle is started.

Figure 2C:
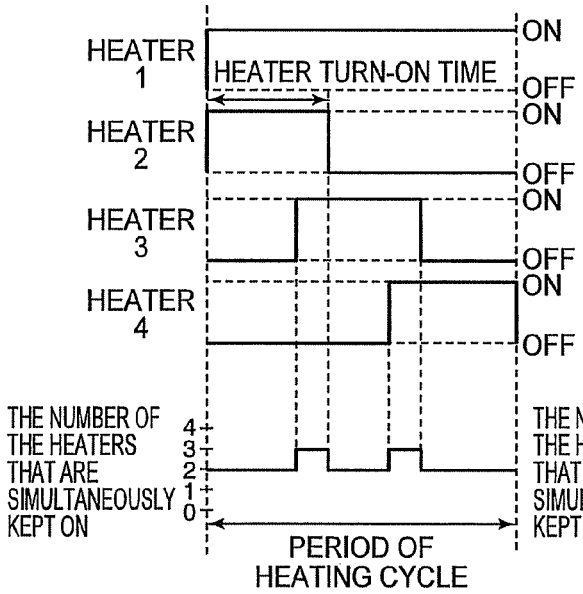
Figure 3A:
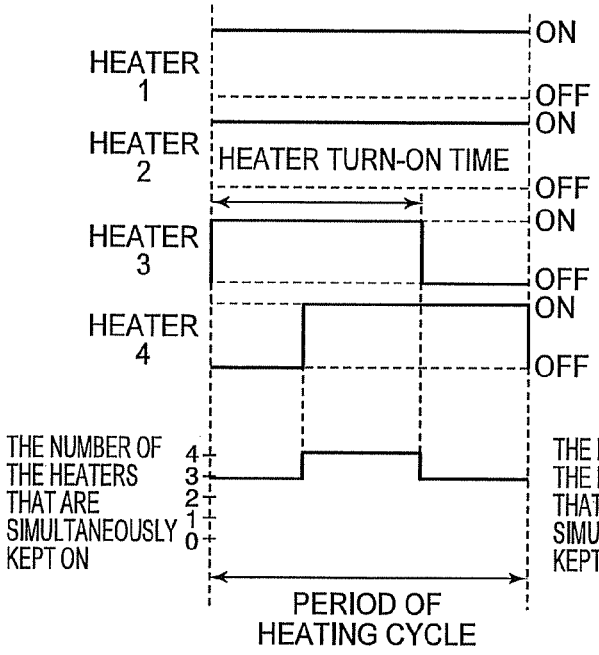
FIGS. 3A and 3B are explanatory views showing the ON/OFF control of each heater by the control part in the heating unit including the four heaters.
Figure 3B:
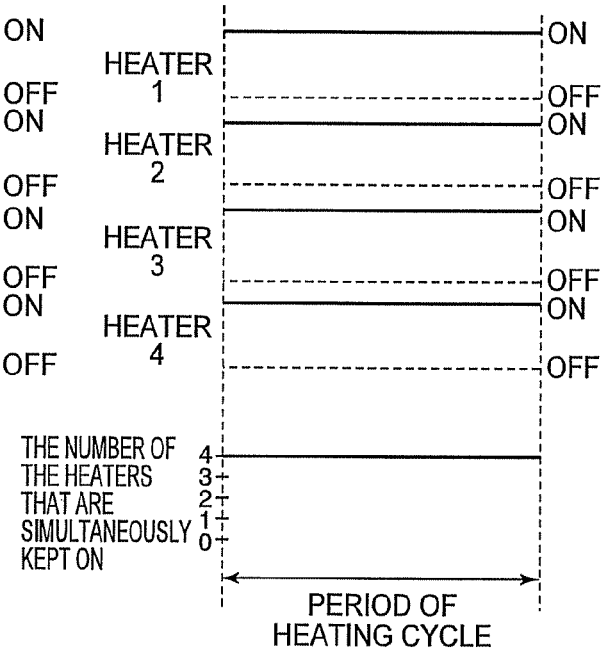

The ON/OFF control of each heater 24*a* by the control part 50 is described more concretely. Based on the Q value (output required amount), the control part 50 selectively performs:

(a) a control in which all the heaters 24*a* are controlled in the periodically divided manner during a heating cycle (see, FIG. 2A);

(b) a control in which one or more heaters 24*a* is controlled in the periodically divided manner during a heating cycle (see, FIG. 2B);

(c) a control in which one or more heaters 24*a* is continuously kept on throughout a heating cycle, and all the heaters 24*a* among the remaining heaters 24*a* are controlled in the periodically divided manner during this heating cycle (see, FIG. 2C and FIG. 3A);

(d) a control in which one or more heaters 24*a* is continuously kept on throughout a heating cycle, and one or more heaters 24*a* among the remaining heaters 24*a* is controlled in the periodically divided manner during this heating cycle; and (e) a control in which all the heaters 24*a* are continuously kept on throughout a heating cycle (see, FIG. 3B).

In this case, the selection of the controls (a) to (e) is performed such that a difference between the maximum number and the minimum number of the heaters 24*a* that are simultaneously kept on during the heating cycle is not more than 1.

In more detail, when the Q value is not more than a first set value, specifically, when the Q value is not more than 160, for example, the control part 50 performs the control in which the four heaters 24*a* (heaters 1 to 4) are controlled in the periodically divided manner during a heating cycle (see, FIG. 2A). When the Q value is larger than the first set value and not more than a second set value, specifically, when the Q value is larger than 160 and not more than 200, for example, the control part 50 performs the control in which the two or three heaters 24*a* (heaters 1 and 2 in FIG. 2B) are controlled in the periodically divided manner (see, FIG. 2B). When the Q value is larger than the second set value and not more than a third set value, specifically, when the Q value is larger than 200 and not more than 250, for example, the control part 50 performs the control in which the one heater 24*a* (heater 1) is continuously kept on throughout a heating cycle, and the remaining three heaters 24*a* (heaters 2 to 4) are controlled in the periodically divided manner during this heating cycle (see, FIG. 2C).

Figure 2D:
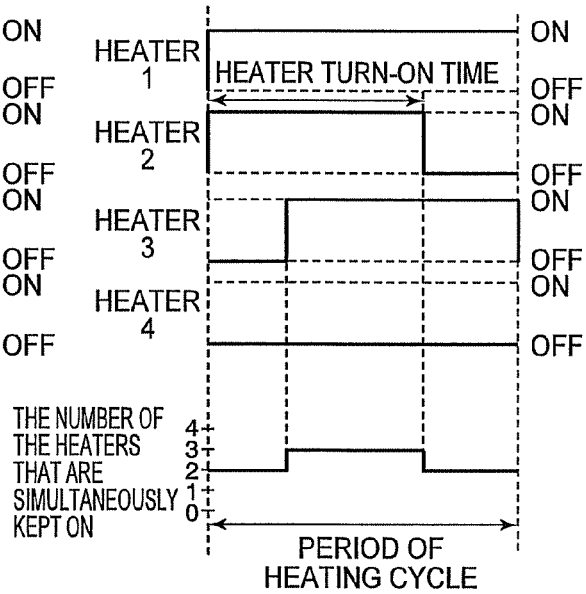

When the Q value is larger than the third set value and is not more than a fourth set value, specifically, when the Q value is larger than 250 and not more than 300, for example, the control part 50 performs the control in which the one heater 24*a* (heater 1) is continuously kept on throughout a heating cycle, and the two remaining heaters 24*a* (heaters 2 and 3) are controlled in the periodically divided manner during this heating cycle (see, FIG. 2D). When the Q value is larger than the fourth set value and smaller than a fifth set value, specifically, when the Q value is larger than 300 and smaller than 400, for example, the two heaters 24*a* (heaters 1 and 2) are continuously kept on throughout a heating cycle, and the remaining two heaters (heaters 3 and 4) are controlled in the periodically divided manner during this heating cycle (see, FIG. 3A). When the Q value is the fifth set value, specifically, when the Q value is 400, for example, the control part 50 performs the control in which the four heaters 24*a* (heaters 1 to 4) are continuously kept on throughout a heating cycle (see, FIG. 3B).

The control part 50 determines: whether there is/are the heater(s) 24*a* that is/are kept on throughout a heating cycle or not; when it is determined that there is/are the heater(s) 24*a* that is/are kept on throughout the heating cycle, the number of the heaters 24*a* that will be continuously kept on throughout the heating cycle; and the number of heaters 24*a* among the remaining heaters 24*a* that will be controlled in the periodically controlled manner during this heating cycle; in the following procedure. Namely, the control part 50 controls the heaters 24*a*, such that the following conditional expression is satisfied.

$$\frac{Q-100\times F}{100\times N} < \frac{2}{N+1} \qquad \text{(Expression 1)}$$

In the above conditional expression, "Q" represents a required output amount (total sum of output amount (%) required for the respective heaters 24*a*), "F" represents the number of the heaters 24*a* that will be kept on throughout a heating cycle, and "N" represents the number of the heaters 24*a* that will be controlled in the periodically divided manner during this heating cycle, excluding the heater(s) 24*a* that will be continuously kept on throughout the heating cycle.

Next, there is described a calculation expression for calculating F based on the above conditional expression.

$$F \geq \frac{Q-200}{100} \qquad \text{(Expression 2)}$$

According to the above calculation expression, when Q is larger than 200, F is not less than 1. Namely, when Q is larger than 200, there is performed a control in which all the heaters 24*a* or one or more heaters 24*a* are continuously kept on throughout a heating cycle, and all the remaining heaters 24*a* or one or more remaining heaters 24*a* are controlled in the periodically divided manner during this heating cycle. On the other hand, according to the above calculation expression, when Q is not more than 200, there is performed a control in which none of the heaters 24*a* is continuously kept on throughout a heating cycle, and all the heaters 24*a* or one or more heaters 24*a* are controlled in the periodically divided manner during this heating cycle.

Next, there is described a method for calculating a period of a heating cycle based on a preset heater turn-on time and a Q value (output required amount).

$$T = \frac{100N}{Q-100\times F}Ta \qquad \text{(Expression 3)}$$

In the above calculation expression, "T" represents a period of a heating cycle, and "Ta" represents a preset heater turn-on time (see, FIG. 2A). T (period of heating cycle) can be calculated by means of the above calculation expression.

Next, there is described a method for calculating, in the control of the heater 24*a* in the periodically divided manner, an interval between timings at which the heaters 24*a* are switched on, i.e., a period between when a certain heater 24*a* is switched on and when a succeeding heater 24*a* is switched on.

$$Tb = \frac{T - Ta}{N - 1} \quad \text{(Expression 4)}$$

In the above calculation expression, "Tb" represents an interval between timings at which the heaters 24 are switched on (see, FIG. 2A). Tb can be calculated by means of the above calculation expression.

For each of the heaters 24*a* (heaters 1 to 4), the control part 50 is capable of storing a cumulative time (cumulative time of use) during which each heater 24*a* is kept on, i.e., used. When one or more heaters 24*a* is continuously kept on throughout a heating cycle (see, FIGS. 2C and 2D, and FIG. 3A), the control part 50 controls the respective heaters 24*a* such that each heater 24*a* to be used is sequentially selected in order of the length of their respective cumulative time of use, such that the heater 24*a* with the shorter cumulative time of use is selected preferentially. Namely, suppose that one or more heaters 24*a* is continuously kept on throughout a heating cycle. In this case, when the heater 4, for example, of the four heaters 24*a* has a cumulative time of use that is shorter than a cumulative time of use of the other three heaters 1 to 3, the heater 4 is preferentially selected as the heater 24*a* that will be continuously kept on throughout the heating cycle.

In addition, when one or more heaters 24*a* is controlled in the periodically divided manner, the control part 50 controls the respective heaters 24*a* such that each heater 24*a* to be used is sequentially selected in order of the length of their respective cumulative time of use, such that the heater 24*a* with the shorter cumulative time of use is selected preferentially. Specifically, as shown in FIG. 2B, suppose that there is performed a control in which two heaters 24*a* out of the four heaters 24*a* are controlled in the periodically divided manner, and the remaining two heaters 24 are kept off. In this case, when the heaters 3 and 4 have a cumulative time of use that is shorter than a cumulative time of use of the other two heaters 1 and 2, the heaters 3 and 4 are preferentially selected as the heaters 24*a* used in the control in the periodically divided manner.

As described above, according to the heating unit in this embodiment and the substrate processing apparatus 1 including the heating unit, the control part 50 calculates a Q value (required output value) such that a temperature of a process liquid heated by the heating unit can be maintained at a predetermined temperature. Based on the Q value, the control part 50 calculates a period (T) of a heating cycle as a synchronization for controlling the heating unit. Then, when the Q value is not more than a predetermined set value (e.g., 200), the control part 50 performs a control in which none of the heaters 24*a* is continuously kept on throughout the heating cycle. When the Q value is larger than the predetermined set value, the control part 50 performs a control in which all or one or more heaters 24*a* are continuously kept on throughout the heating cycle. Further, during this heating cycle, the control part 50 performs a control in which all or one or more of the remaining heaters 24*a* are controlled in the periodically divided manner. At this time, the control part 50 controls ON/OFF of each heater 24*a* such that a difference between the maximum number and the minimum number of the heaters 24*a* that are simultaneously kept on during the heating cycle is not more than 1. Namely, as shown in FIGS. 2A to 2D and FIGS. 3A and 3B, since there is selectively performed the control in which all the heaters 24*a* or one or more heaters 24*a* are continuously kept on throughout the heating cycle such that a difference between the maximum number and the minimum number of the heaters 24*a* that are simultaneously kept on during the heating cycle is not more than 1, the number of the heaters 24*a* that are simultaneously kept on can be prevented from drastically varying during the heating cycle. Therefore, it can be restrained that a heating degree of the process liquid during the heating cycle drastically varies over time.

In addition, the heater turn-on time is previously set at a predetermined period time or more, and a period of a heating cycle is calculated based on the heater turn-on time and a Q value (output required amount). Therefore, it can be prevented that the heater turn-on time becomes shorter than the predetermined time, resulting in a breaking of wire of the heater 24*a*.

For each of the heaters 24*a*, the control part 50 is capable of storing a cumulative time (cumulative time of use) during which each heater 24*a* is kept on, i.e., used. When one or more heaters 24*a* is continuously kept on throughout a heating cycle, the control part 50 controls the respective heaters 24*a* such that each heater 24*a* to be used is sequentially selected in order of the length of their respective cumulative time of use, such that the heater 24*a* with the shorter cumulative time of use is selected preferentially. Namely, when one or more heaters 24*a* is continuously kept on throughout a heating cycle, the heater 24*a* with a shorter cumulative time of use is preferentially used. Therefore, a time point at which each heater 24*a* of the heating unit cannot be used because of its life can be delayed, whereby an exchange frequency of the heaters 24*a* in the heating unit can be decreased.

In addition, when one or more heaters 24*a* is controlled in the periodically divided manner during a heating cycle, the control part 50 controls the respective heaters 24*a* such that each heater 24*a* to be used is sequentially selected in order of the length of their respective cumulative time of use, such that the heater 24*a* with the shorter cumulative time of use is selected preferentially. Thus, when one or more heaters 24*a* is controlled in the periodically divided manner during a heating cycle, the heater 24*a* with a shorter cumulative time of use is preferentially used. Therefore, a time point at which each heater 24*a* of the heating unit cannot be used because of its life can be delayed, whereby an exchange frequency of the heaters 24*a* in the heating unit can be decreased.

The heating unit in this embodiment and the substrate processing apparatus 1 including the heating unit are not limited to the above embodiment, but can be variously modified.

For example, the number of the heaters 24*a* in the heating part 24 is not limited to four. The number of the heaters 24*a* may be three, or five or more, for example.

With reference to FIG. 4, there is described a case in which the number of the heaters 24*a* in the heating unit 24 is three.

When the number of the heaters 24*a* in the heating part 24 is three, the control part 50 also controls ON/OFF of each heater 24*a* such that all the heaters 24*a* (i.e., three heaters 24*a*) or one or two heaters 24*a* are kept on for a preset heater turn-on time. In this case, since the number of the heaters 24*a* in the heating part 24 is three, a Q value varies within a range between 0 and 300.

Figure 4A:
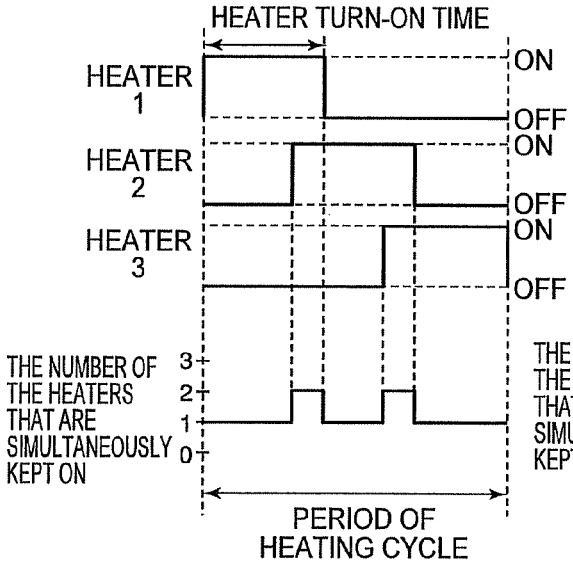
FIGS. 4A to 4D are explanatory views showing an ON/OFF control of each heater by a control part in a heating unit including three heaters.
Figure 4B:
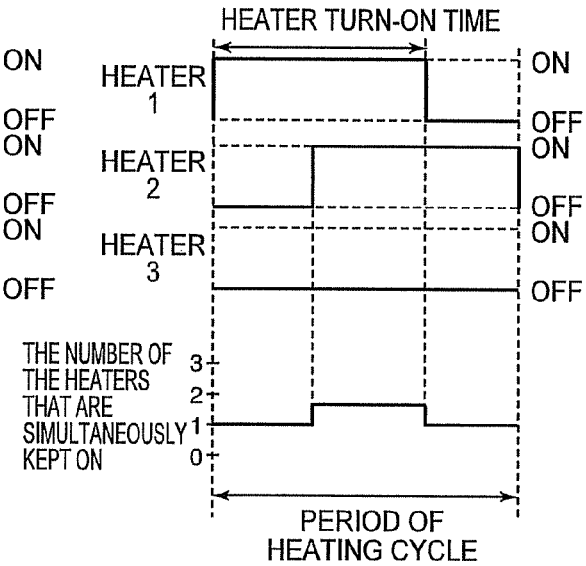
Figure 4C:
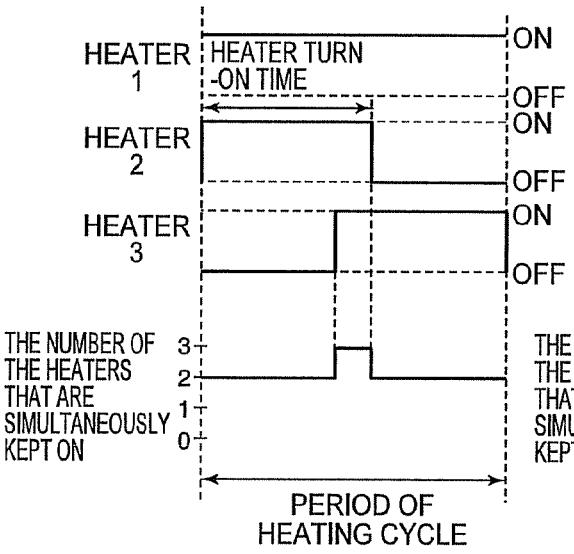
Figure 4D:
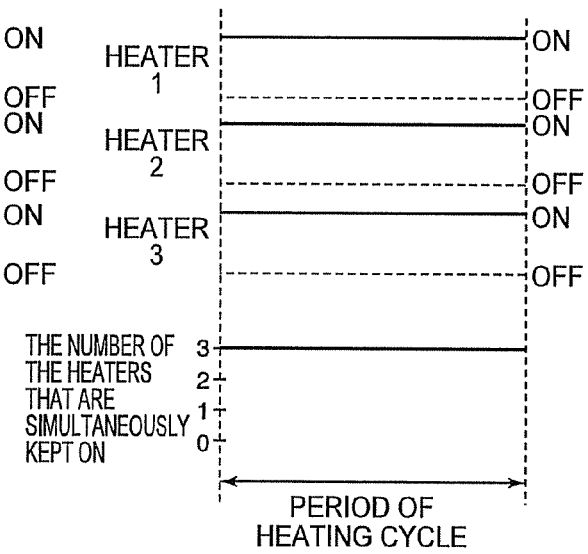

When the Q value is not more than a predetermined set value, specifically, when the Q value is not more than 200, for example, as shown in FIGS. 4A and 4B, the control part 50 performs a control in which none of the heaters 24*a* is continuously kept on throughout a heating cycle, and all the heaters 24*a* or one or two heaters 24*a* are controlled in the periodically divided manner during this heating cycle. On the other hand, when the Q value is larger than the predetermined set value, specifically, when the Q value is larger than 200, for example, as shown in FIGS. 4C and 4D, the control part 50 performs a control in which all or one or two heaters 24*a* are continuously kept on throughout a heating cycle, and all or one or two of the remaining heaters 24*a* are controlled in the periodically divided manner during this heating cycle. At this time, as shown in FIGS. 4A and 4D, ON/OFF of each heater 24 is controlled such that a difference between the maximum number and the minimum number of the heaters 24*a* that are simultaneously kept on during the heating cycle is not more than 1.

In more detail, when the Q value is not more than a first set value, specifically, when the Q value is not more than 150, for example, the control part 50 performs the control in which the three heaters 24*a* (heaters 1 to 3) are controlled in the periodically divided manner during a heating cycle (see, FIG. 4A). When the Q value is larger than the first set value and not more than a second set value, specifically, when the Q value is larger than 150 and not more than 200, for example, the control part 50 performs the control in which the two heaters 24*a* (heaters 1 and 2) are controlled in the periodically divided manner during a heating cycle (see, FIG. 4B). When the Q value is larger than the second set value and smaller than a third set value, specifically, when the Q value is larger than 200 and smaller than 300, for example, the control part 50 performs the control in which the one heater 24*a* is continuously kept on throughout a heating cycle, and the remaining two heaters 24*a* (heaters 2 and 3) are controlled in the periodically divided manner during this heating cycle (see, FIG. 4C). When the Q value is the third set value, specifically, when the Q value is 300, for example, the control part 50 performs the control in which the three heaters 24*a* (heaters 1 to 3) are continuously kept on throughout a heating cycle (see, FIG. 4D).

As described above, when the number of the heaters 24*a* in the heating part 24 is three, the control part 50 also calculates a Q value (required output amount) such that a temperature of the process liquid heated by the heating unit can be maintained at a predetermined temperature. Then, when the Q value is not more than a predetermined set value (e.g., 200), the control part 50 performs the control in which none of the heaters 24*a* is continuously kept on throughout a heating cycle. When the Q value is larger than the predetermined set value, the control part 50 performs the control in which all or one or two heaters 24*a* are continuously kept on throughout a heating cycle, and the remaining heaters 24*a* are controlled in the periodically divided manner during this heating cycle. At this time, the control part 50 controls ON/OFF of each heater 24*a* such that a difference between the maximum number and the minimum number of the heaters 24*a* that are simultaneously kept on during the heating cycle is not more than 1. Namely, as shown in FIGS. 4A to 4D, since there is selectively performed the control in which all or one or two heaters 24*a* are continuously kept on throughout the heating cycle such that a difference between the maximum number and the minimum number of the heaters 24*a* that are simultaneously kept on during the heating cycle is not more than 1, the number of the heaters 24*a* that are simultaneously kept on can be prevented from drastically varying during the heating cycle. Therefore, it can be restrained that a heating degree of the process liquid during the heating cycle drastically varies over time.

Figure 5:
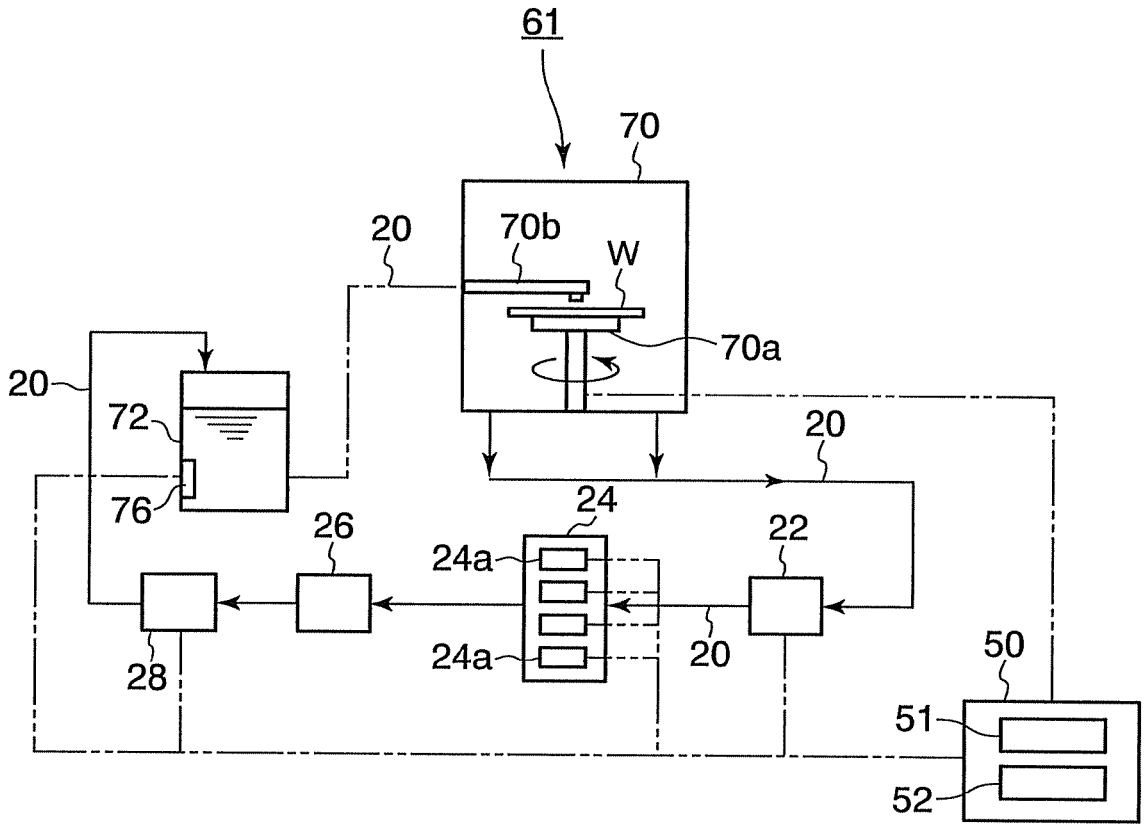
FIG. 5 is a schematic structural view showing an overall structure of another substrate processing apparatus of the present invention.
Figure 6:
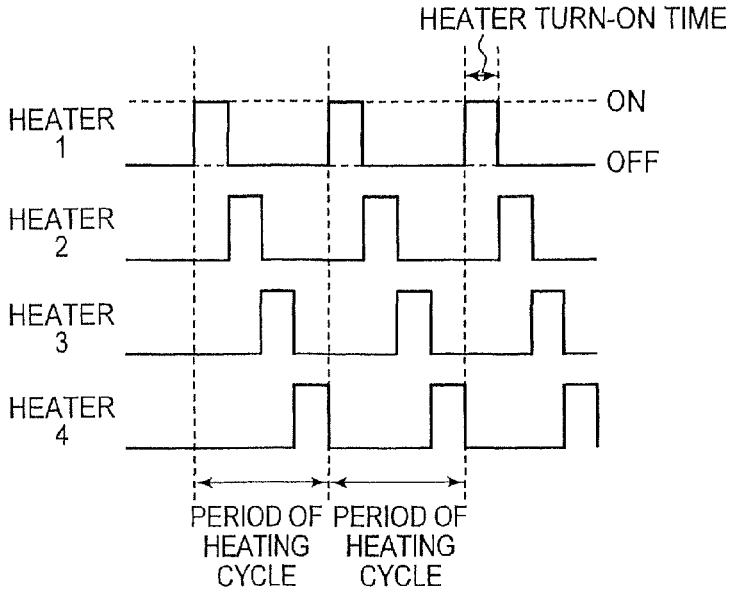
FIG. 6 PRIOR ART
FIG. 6 is an explanatory view showing an ON/OFF control of each heater in a conventional substrate processing apparatus.
Figure 7:
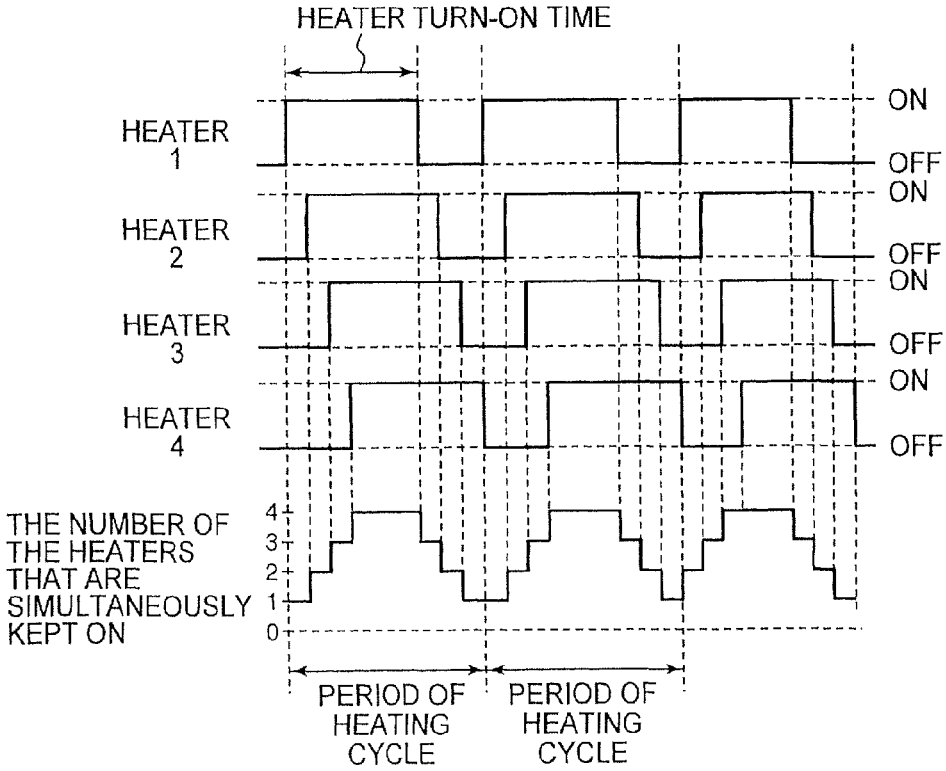
FIG. 7 PRIOR ART
FIG. 7 is an explanatory view showing the ON/OFF control of each heater in the conventional substrate processing apparatus.

Moreover, instead of the use of a substrate processing apparatus of a batch type as shown in FIG. 1, a substrate processing apparatus of a single-wafer type may be used. With reference to FIG. 5, an overall structure of a single-wafer type substrate processing apparatus is described. In the substrate processing apparatus 61 shown in FIG. 5, the same parts as those of the substrate processing apparatus shown in FIG. 1 are shown by the same reference numbers, and their detailed description is omitted.

As shown in FIG. 5, the substrate processing apparatus 61 of a single-wafer type includes a processing tank 70 configured to process wafers W one by one. The processing tank 70 processes a wafer W by supplying a process liquid onto a surface of the wafer W placed on a wafer chuck 70*a* in a substantially horizontal direction. A process-liquid supply nozzle 70*b* is disposed in the processing tank 70, and a process liquid is supplied onto a surface of a wafer W from the process-liquid supply nozzle 70*b*. The process-liquid supply nozzle 70*b* is connected to a downstream end of a circulation path 20. In addition, as shown in FIG. 5, on a downstream side of a flowmeter 28 in the circulation path 20, there is arranged a storage tank 72 storing a process liquid. A process liquid flowing through the circulation path 20 is temporarily stored in the storage tank 72, and the process liquid is then sent from the storage tank 72 to the process-liquid supply nozzle 70*b*. Arranged in the storage tank 72 is a temperature measuring sensor 76 configured to measure a temperature of the process liquid stored in the storage tank 72. A measurement result of a temperature of the process liquid which is measured by the temperature measuring sensor 76 is sent to a control part 80. Since a temperature of the process liquid stored in the storage tank 72 and a temperature of the process liquid to be supplied onto a surface of a wafer W from the storage tank 72 through the process-liquid supply nozzle 70*b* are substantially same, a temperature of the process liquid in the processing tank 70 can be measured by measuring a temperature of the process liquid stored in the storage tank 72 by means of the temperature measuring sensor 76.

A circulation pump 22 is configured to draw the process liquid stored in the processing tank 70, transfer the process liquid through the circulation path 20, and to send the process liquid to the process-liquid supply nozzle 70*b* through the storage tank 72. An operation of the circulation pump 22 is controlled by the control part 80.

The control part 80 is connected to the respective elements of the substrate processing apparatus 61 so as to control operations of the respective elements. Specifically, sent to the control part 80 is a measurement result of a temperature of the process liquid in the storage tank 72 which is measured by the temperature measuring sensor 76. In order that a temperature of the process liquid measured by the temperature measuring sensor 76 can be maintained at a preset temperature, the control part 80 is configured to control ON/OFF of each heater 24*a* such that all the heaters 24*a* or one or more heater 24*a* are kept on for a predetermined heater turn-on time during each heating cycle. A method for controlling ON/OFF of the respective heaters 24*a* by the control part 80 is the same as the method for controlling ON/OFF of the respective heaters 24*a* by the control part 50 as shown in FIG. 1.

The invention claimed is:

1. A heating unit configured to heat a fluid, the heating unit comprising:

at least three heating devices respectively configured to heat the fluid; and a control part configured to control ON/OFF of each of the heating devices;

wherein:

the control part is configured to calculate a required output amount of the heating unit such that a temperature of the fluid heated by the heating unit can be maintained at a predetermined temperature, and calculate a period of a heating cycle based on the required output amount; and the control part is also configured to select one control mode from a plurality of control modes based on the required output amount of the heating unit and configured to perform the selected control mode in the heating cycle, the control modes including:

(A) a first control mode to be selected when the required output amount is not more than a predetermined set value in which none of the heating devices is continuously kept on throughout the heating cycle, and at least two heating devices are controlled in a periodically divided manner during the heating cycle with a heater on time of each one of said at least two heating devices only partially overlapping with a heater on time of another one of said at least two heating devices, and with a difference between the maximum number and the minimum number of the heating devices that are simultaneously kept on during the heating cycle being maintained at not more than 1; and (B) a second control mode to be selected when the required output amount is larger than the predetermined set value in which at least one heating device is continuously kept on throughout the heating cycle, and at least two heating devices among the remaining heating devices are controlled in the periodically divided manner during the heating cycle with a heater on time of each one of said at least two heating devices only partially overlapping with a heater on time of another one of said at least two heating devices and with a difference between the maximum number and the minimum number of the heating devices that are simultaneously kept on during the heating cycle being maintained at not more than 1.

2. The heating unit according to claim 1, wherein while the control is in the periodically divided manner during the heating cycle, said at least two heating devices are sequentially switched on in order at a fixed time interval, and are sequentially switched off in order at the same fixed time interval.

3. The heating unit according to claim 2, wherein in the control part, the predetermined time in the control of the periodically divided manner is previously set at a predetermined value or more.

4. The heating unit according to claim 1, wherein, based on the required output amount, the control part selectively performs:

(a) a control in which all the heating devices are controlled in the periodically divided manner during the heating cycle;

(b) a control in which one or more heating devices is controlled in the periodically divided manner during the heating cycle;

(c) a control in which one or more heating devices is continuously kept on throughout the heating cycle, and all the heating devices among the remaining heating devices are controlled in the periodically divided manner during this heating cycle;

(d) a control in which one or more heating devices is continuously kept on throughout the heating cycle, and one or more heating devices among the remaining heating devices is controlled in the periodically divided manner during this heating cycle; and (e) a control in which all the heating devices are continuously kept on throughout the heating cycle.

5. The heating unit according to claim 1, wherein:

the number of the heating devices is three; and the control part performs:

when the required output amount is not more than a first set value, a control in which the three heating devices are controlled in the periodically divided manner during the heating cycle;

when the required output amount is larger than the first set value and not more than a second set value, a control in which the two heating devices are controlled in the periodically divided manner during the heating cycle;

when the required output amount is larger than the second set value and smaller than a third set value, a control in which the one heating device is continuously kept on throughout the heating cycle, and the remaining two heating devices are controlled in the periodically divided manner during this heating cycle; and when the required output amount is the third set value, the three heating devices are continuously kept on throughout the heating cycle.

6. The heating unit according to claim 1, wherein:

the number of the heating devices is four; and the control part performs:

when the required output amount is not more than a first set value, a control in which the four heating devices are controlled in the periodically divided manner during the heating cycle;

when the required output amount is larger than the first set value and not more than a second set value, a control in which the two or three heating devices are controlled in the periodically divided manner during the heating cycle;

when the required output amount is larger than the second set value and not more than a third set value, a control in which the one heating device is continuously kept on throughout the heating cycle, and the remaining three heating devices are controlled in the periodically divided manner during this heating cycle;

when the required output amount is larger than the third set value and not more than a fourth set value, a control in which the one heating device is continuously kept on throughout the heating cycle, one heating device is continuously kept off throughout the heating cycle, and the remaining two heating devices are controlled in the periodically divided manner during this heating cycle;

when the required output amount is larger than the fourth set value and smaller than a fifth set value, a control in which the two heating devices are continuously kept on throughout the heating cycle, and the remaining two heating devices are controlled in the periodically divided manner during this heating cycle; and when the required output amount is the fifth set value, the four heating devices are continuously kept on throughout the heating cycle.

7. The heating unit according to claim 2, wherein:

the control part makes the predetermined time constant in the control of periodically divided manner;

the control part calculates an operation amount within a range between 0 and 1 by means of a feedback control, such that a temperature of the fluid heated by the heating unit can be maintained at a predetermined temperature;

the control part calculates the required output amount by multiplying the operation amount by the number of the heating devices; and the control part calculates a period of the heating cycle based on the required output amount and the predetermined time.

8. The heating unit according to claim 1, wherein:

the control unit is capable of storing a cumulative time during which each heating device is kept on; and when one or more heating devices are continuously kept on throughout the heating cycle, the control part controls the respective heating devices such that each heating device to be used is sequentially selected in order of the length of their respective cumulative time of use, such that the heating device with the shorter cumulative time of use is selected preferentially.

9. The heating unit according to claim 1, wherein:

the control unit is capable of storing a cumulative time during which each heating device is kept on; and when one or more heating devices is controlled in the periodically divided manner, the control part controls the respective heating devices such that each heating device to be used is sequentially selected in order of the length of their respective cumulative time of use, such that the heating device with the shorter cumulative time of use is selected preferentially.

10. A substrate processing apparatus comprising:

a processing tank configured to process a substrate by means of a process liquid;

a circulation path to which the process liquid is sent from the processing tank, and through which the process liquid is returned to the processing tank;

a heating unit according to claim 1, the heating unit being disposed in the circulation path so as to heat the process liquid flowing through the circulation path; and a temperature measuring part configured to measure a temperature of the process liquid in the processing tank;

wherein:

the control part of the heating unit calculates a required output amount in the heating unit by a feedback control, such that a temperature of the process liquid measured by the temperature measuring part can be maintained at a predetermined temperature; and the control part controls the respective heating devices of the heating unit according to the selected control mode.

11. A method for heating a fluid by means of a heating unit including a plurality of heating devices respectively configured to heat the fluid, the method comprising:

calculating a required output value such that a temperature of the fluid heated by the heating unit can be maintained at a predetermined temperature;

calculating a period of a heating cycle based on the required output amount;

selecting one control mode from a plurality of control modes based on the required output amount of the heating unit; and performing the selected control mode in the heating cycle, the control modes including:

(A) a first control mode to be selected when the required output amount is not more than a predetermined set value in which none of the heating devices is continuously kept on throughout the heating cycle, and at least two heating devices are controlled in a periodically divided manner during the heating cycle with a heater on time of each one of said at least two heating devices only partially overlapping with a heater on time of another one of said at least two heating devices and with a difference between the maximum number and the minimum number of the heating devices that are simultaneously kept on during the heating cycle being maintained at not more than 1; and (B) a second control made to be selected when the required output amount is larger than the predetermined set value in which at least one heating device is continuously kept on throughout the heating cycle, and at least two heating devices among the remaining heating devices are controlled in the periodically divided manner during the heating cycle with a heater on time of each one of said at least two heating devices only overlapping with a heater on time of another one of said at least two heating devices and with a difference between the maximum number and the minimum number of the heating devices that are simultaneously kept on during the heating cycle being maintained at not more 1.

12. The method for heating a fluid according to claim 11, wherein while the control is in the periodically divided manner during the heating cycle, said at least two heating devices are sequentially switched on in order at a fixed tune interval, and are sequentially switched off in order at the same fixed time interval.

13. The method for heating a fluid according to claim 12, wherein the predetermined time in the control of the periodically divided manner is previously set at a predetermined value or more.

14. The method for heating a fluid according to claim 11, wherein when each heating device is controlled, there is selectively performed, based on the required output amount:

(a) a control in which all the heating devices are controlled in the periodically divided manner during the heating cycle;

(b) a control in which one or more heating devices is controlled in the periodically divided manner during the heating cycle;

(c) a control in which one or more heating devices is continuously kept on throughout the heating cycle, and all the heating devices among the remaining heating devices are controlled in the periodically divided manner during this heating cycle;

(d) a control in which one or more heating devices is continuously kept on throughout the heating cycle, and one or more heating devices among the remaining heating devices is controlled in the periodically divided manner during this heating cycle; and (e) a control in which all the heating devices are continuously kept on throughout the heating cycle.

* * * * *

UNITED STATES PATENT AND TRADEMARK OFFICE

CERTIFICATE OF CORRECTION

PATENT NO. : 8,803,039 B2
APPLICATION NO. : 12/509725
DATED : August 12, 2014
INVENTOR(S) : Hideaki Sato and Hiromi Hara It is certified that error appears in the above-identified patent and that said Letters Patent is hereby corrected as shown below:

Title Page, Item (56) Other Publications

Please add: "German Office Action, dated January 11, 2013."

Title Page, Item (56) U.S. Patent Documents

Please add: "7,668,445 B2 * 2/2010 Miller et al."

Signed and Sealed this
Sixth Day of January, 2015

Michelle K. Lee

Michelle K. Lee
*Deputy Director of the United States Patent and Trademark Office*